US006033256A

United States Patent [19]

Odorfer

[11] Patent Number: 6,033,256

[45] Date of Patent: Mar. 7, 2000

[54] SLIMLINE PLUG-IN CONNECTOR

[75] Inventor: Frank Odorfer, Nuremberg, Germany

[73] Assignee: Framatome Connectors International, Courbevoie, France

[21] Appl. No.: 09/106,618

[22] Filed: Jun. 29, 1998

[30] Foreign Application Priority Data

Jul. 3, 1997 [DE] Germany ..... 197 28 448

[51] Int. Cl.[7] ..... H01R 13/127

[52] U.S. Cl. ..... 439/465

[58] Field of Search ..... 439/465–467, 439/687, 696, 731, 357, 341

[56] References Cited

U.S. PATENT DOCUMENTS 5,080,603 1/1992 Mouissie ..... 439/353

FOREIGN PATENT DOCUMENTS

0591948 A2 4/1994 European Pat. Off. .

*Primary Examiner*—Michael L. Gellner
*Assistant Examiner*—Briggitte Hammond
*Attorney, Agent, or Firm*—Perman & Green, LLP

[57] ABSTRACT

The present invention relates to a plug-in connector (1) for connection to a firing element receptacle (2), having a plug adapter (3), locking arms (4) and a plug body (5), the plug body having in a cable-receiving groove, which has teeth (10), a connecting cable (6) which is connected to contacts (7, 8), and having a housing cover (11), which rests on the upper side of the plug body (5). The fastening of the housing cover (11) on the upper side of the plug body (5) takes place by means of lateral and rear fastening lugs (12, 13), which extend downwards from the cover (11), the rear fastening lugs (13) being clipped into by detents (14), which are arranged on U-shaped flexible legs (15), which in turn are arranged in the vicinity of the cable-receiving groove (9) on the plug body (5).

12 Claims, 3 Drawing Sheets

SLIMLINE PLUG-IN CONNECTOR

BACKGROUND OF THE INVENTION

The present invention relates to a plug-in connector according to the precharacterizing clause of Patent claim 1.

Plug-in connectors of this type are used, in particular, for connecting airbag firing systems and for fitting onto their firing element receptacles. The firing element receptacles are situated at locations in an automobile where slimline dimensioning of the plug-in connectors is important for reasons of space.

Plug-in connectors for connection to a firing element receptacle are already known, these connectors having a firing element adapter, locking arms and a plug body, the plug body receiving a connecting cable in a cable-receiving groove (9) which is provided with retaining teeth (10). The connecting cable is connected to contacts and a housing cover closes off the housing body at the top.

In the past, the fastening of the housing cover to the housing body was achieved unsatisfactorily, inasmuch as forces acting on the connection cable transversely to its longitudinal extent were able to cause the cable to be torn out and the housing cover to be lifted off.

The airbag plug according to the prior art (for example EP 0 591 948) has, furthermore, secondary locking means, which comprises locking arms which are arranged on a stem captively fastened to the plug housing and are pushed through the housing cover between the locking arms and the plug adapter. Consequently, unintentional detachment of the airbag plug from the firing element receptacle was made impossible. In the case of this known plug-in connector, removal of a jumper from the firing element pins takes place when the plug adapter is inserted into the corresponding counterpart on the firing element receptacle. Thus, at a time when the plug-in connector has not yet arrived in its final position on the plug receptacle. This may result in an undefined position of the plug-in connector, it not being possible to check the position of the secondary locking means.

The present invention is based on the object of improving a plug-in connector of the generic type in such a way that tearing out of the housing cover is impossible and checking the position of the plug-in connector and of the secondary locking means becomes possible electrically by means of the jumper, without any additional outlay.

This object is achieved according to the claims. Preferred embodiments of the present invention are characterized in the subclaims.

BRIEF DESCRIPTION OF THE DRAWINGS

The invention is explained in more detail below by describing an exemplary embodiment, with reference to the drawing, in which.

DETAILED DESCRIPTION OF THE PREFERRED EMBODIMENT

Figure 1:
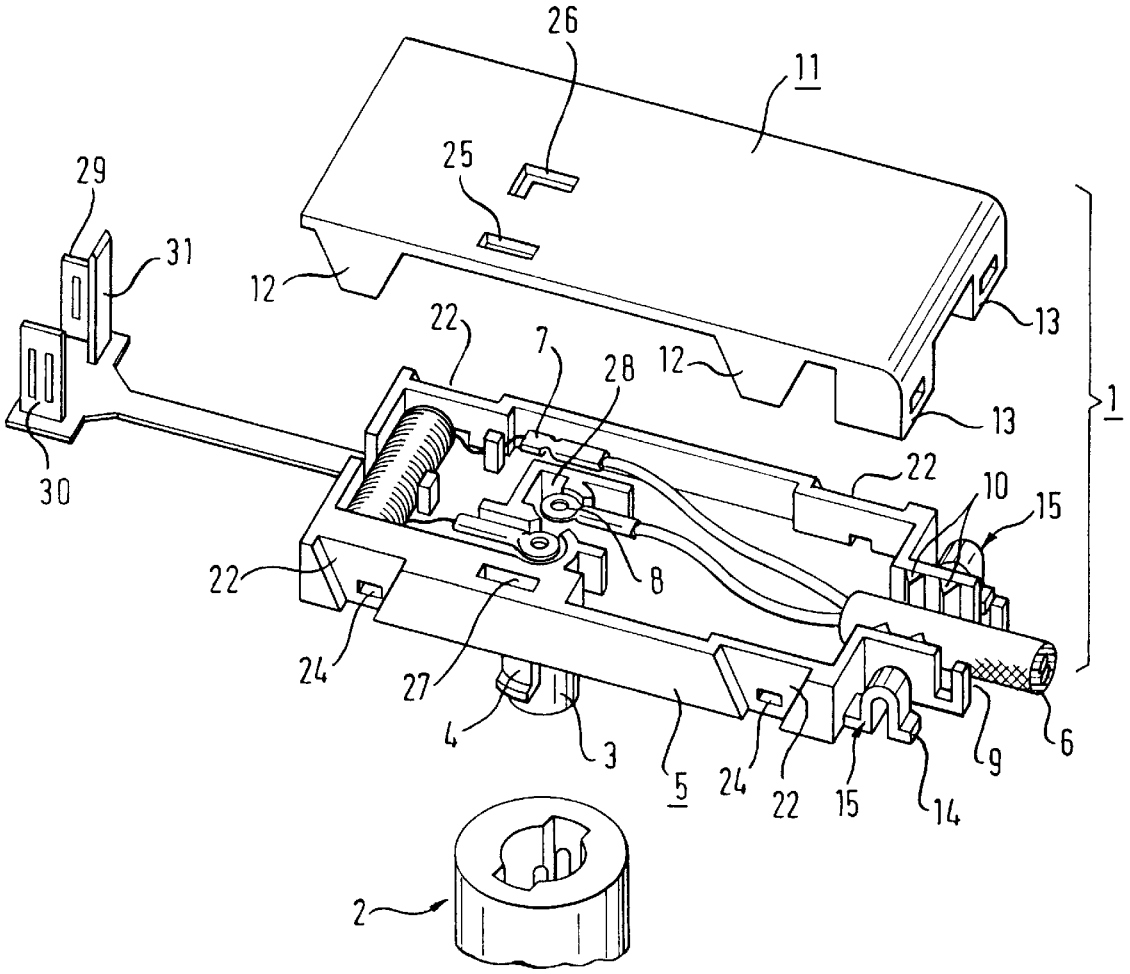
FIG. 1 shows a perspective view of the plug-in connector according to the invention.

FIG. 1 shows the plug-in connector 1, which is fitted onto the firing element receptacle 2 of an airbag restraint system.

Figure 2:
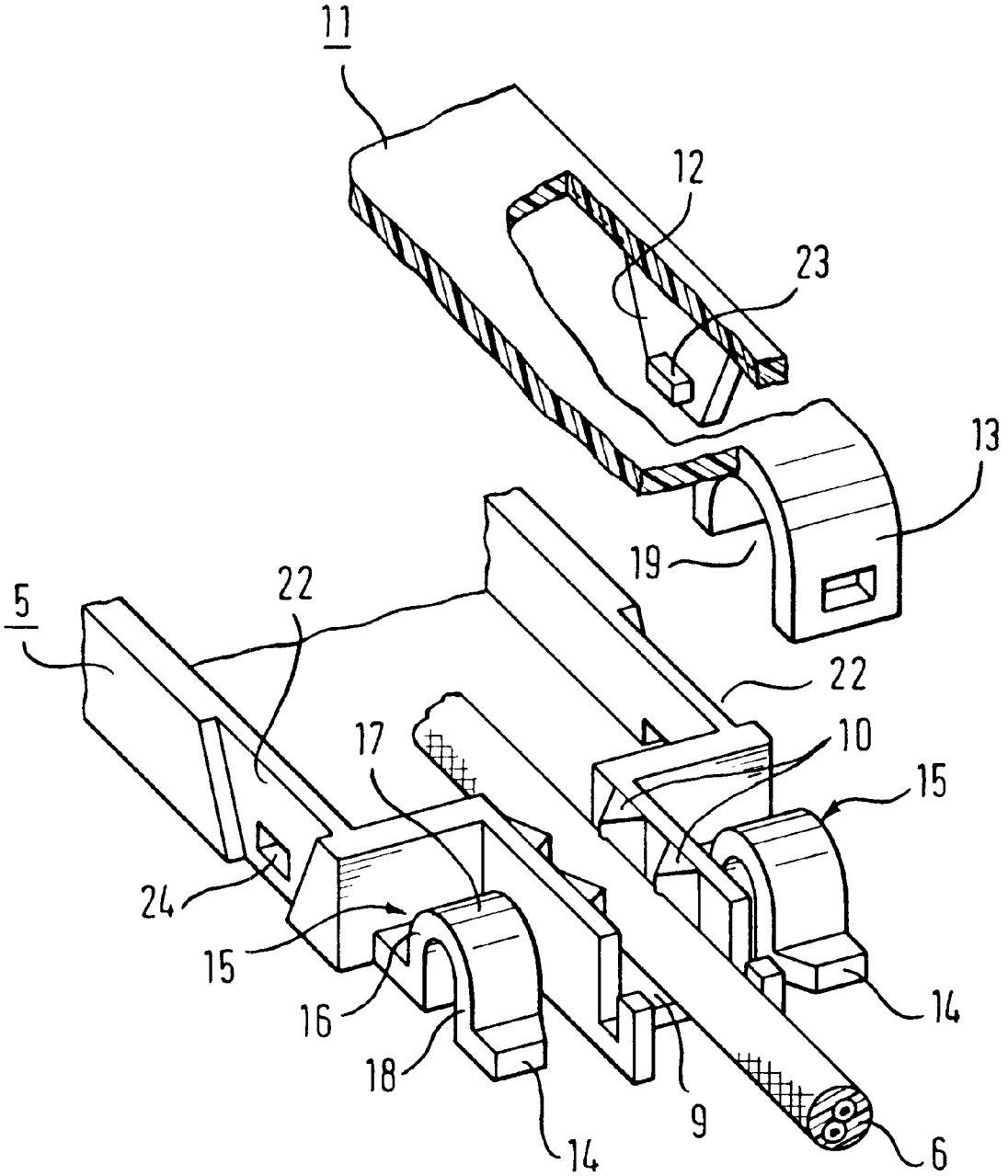
FIG. 2 shows views of details of the cable outlet and of the locking of the housing cover.

A plug adapter 3 is plugged, together with locking arms 4 attached at the sides and parallel to the plugging direction, into the corresponding counterpart in the firing element receptacle 2. The plug body 5 is of a low overall height. On the right-hand side, the connecting cable 6, with its sheathing, is introduced into the plug body 5, where the connecting cables are connected to the contacts 7, 8. The connecting cable 6 lies in the plug body in a cable-receiving groove 9, which is provided with cells 10 or ribs which run transversely to the longitudinal extent of the cable, engage in the cable sheath and thus prevent the cable from being torn out by squeezing it. A cover 11 closes the plug body 5 at the top and has fastening lugs 12 on its side edges, and also rear fastening lugs 13 to both sides of the cable outlet. The rear fastening lugs 13 are open downwards, the opening having a U-shaped profile 19 and enclosing U-shaped legs 15, which are arranged correspondingly on the plug body 5. These counterparts form an inverted U, with two straight legs 16, 18 and a bent part 17 arching over them. Formed on the lowermost end of the straight leg 18 is a detent 14, which clips into a corresponding opening on the rear fastening lug as soon as the cover 11 is pressed onto the plug body 5. Detents 23 are correspondingly arranged on the lateral fastening lugs 12; they can be seen in FIG. 2 and clip into corresponding openings in the side walls of the plug body 5. These openings lie in the lower region of angled-off trapezoidal recesses in the side walls, into which the correspondingly shaped lugs 12 engage, and, in the clipped state, are aligned with the side wall of the plug body.

Figure 3:
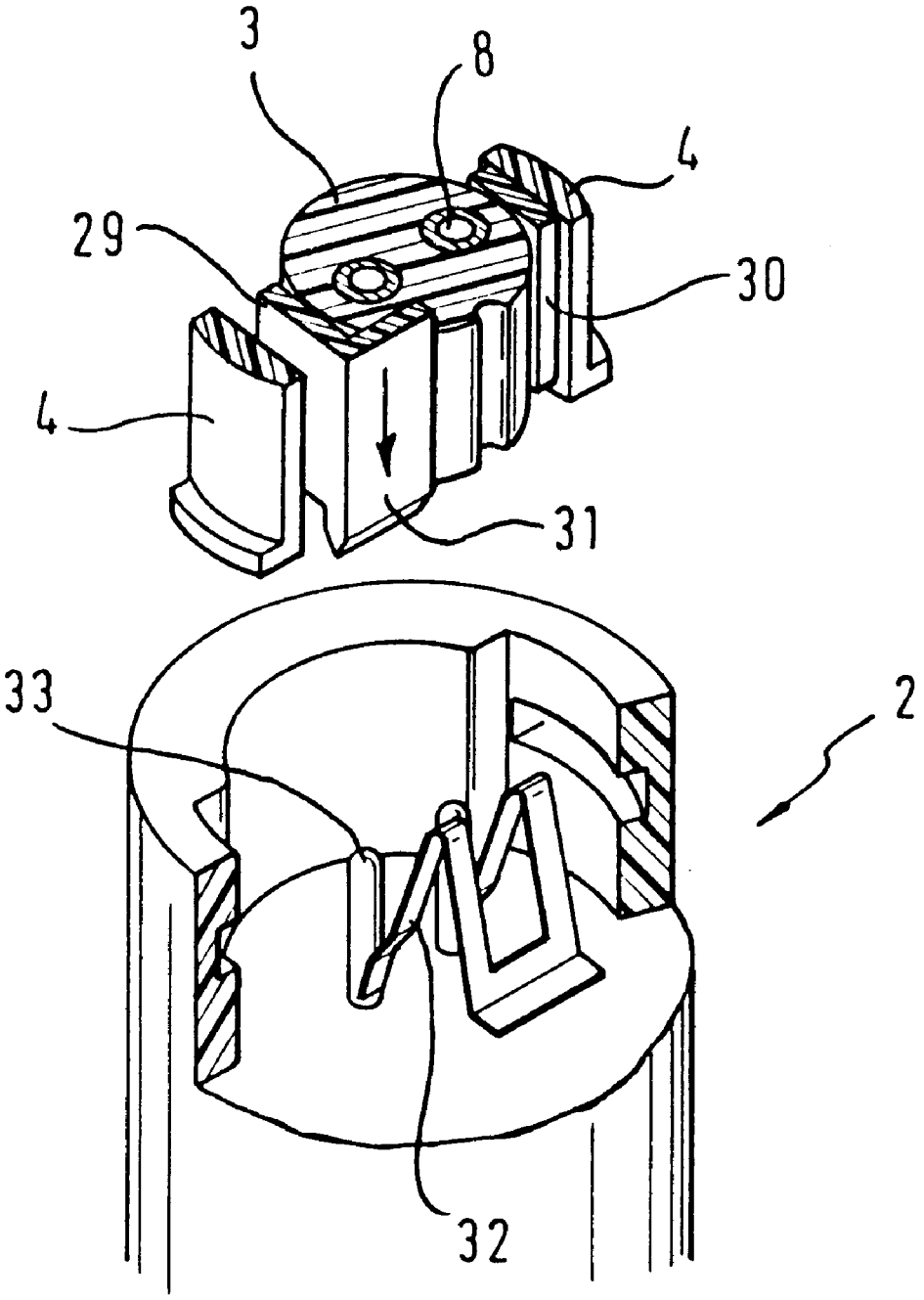
FIG. 3 shows a perspective, partially sectional part-view of the plug adapter and its counterpart in the firing element receptacle of an airbag system.

Provided in the housing cover are openings 25, 26, with which corresponding openings 27, 28 in the plug body 5 are aligned and which allow secondary locking arms, which are captively fastened on a stem, to penetrate through the plug cover 11 and the plug body 5 between the plug adapter 3 and the locking arms 4. A secondary locking arm 29 has an attachment 31 which, as FIG. 3 shows, makes it possible to detach the jumpering clip 32 from the contact 33, in that it wedges itself between the two. Consequently, only when the secondary locking is inserted, with the plug-in connection in the plugged-together state, is the jumpering overcome and the plugging of the secondary locking can be checked electrically, without any additional outlay. Since, in this state, at the same time unintentional detachment is no longer possible on account of the engagement of the secondary locking arms, a more secure state is thereby ensured in an optimum way.

I claim:

1. A plug-in connector (1) for connection to a firing element receptacle (2), having a plug adapter (3), locking arms (4) and a plug body (5), the plug body having a cable-receiving groove, which has teeth (10), a connecting cable (6) which is connected to contacts (7, 8), and having a housing cover (11), which rests on the upper side of the plug body (5), characterized in that lateral and rear fastening lugs (12, 13) disposed on said housing cover (11) which extend downwards from the cover (11), U-shaped flexible legs (15) disposed on the plug body, said U-shaped flexible legs having detents and being arranged on said plug body such that the detents on the U-shaped flexible legs clip into the rear fastening lugs (13) which said U-shaped flexible legs in turn are arranged in the cable-receiving groove (9) on the plug body (5).

2. The plug-in connector according to claim 1, characterized in that the U-shaped flexible legs each having a free end disposed oppositely of a bottom and each arranged opening upwards and have a first straight leg (16), the free end of which is connected to the plug body (5) at its bottom, having a curved region (17), which extends to the upper side of the plug body (5) and a second straight leg (18), at the free end of which the detent (14) is arranged.

3. The plug-in connector according to claim 2, characterized in that the underside of the cover (11) has U-shaped profiles (19), which are shaped to complement the second straight leg (18) and at least part of the curved part (17) of the U-shaped flexible leg, so that these profiles receive the flexible legs and the rear fastening lugs of the cover represent part of these profiles.

4. The plug-in connector according to claim 1, characterized in that the lateral fastening lugs (12) have bevelled sides, which engage in correspondingly bevelled recesses (22) in the plug body (5) and have fastening detents (23), which clip into fastening grooves (24) at the lower end of the bevelled recesses (22).

5. The plug-in connector according to claim 1, characterized in that the plug body (5) and the cover (11) are provided with openings (25, 26, 27, 28), which are shaped in such a way that they receive secondary locking arms (29, 30), which in the state in which they are inserted into the plug body (5) lie between the plug adapter (3) and the locking arms (4), in order to fix the locking arms in this vertical position.

6. The plug-in connector according to claim 5, characterized in that at least one of the secondary locking arms is provided with an arm attachment (31), which is shaped in such a way that it removes a jumpering clip (32) from at least one contact pin (33) in the firing element receptacle (2).

7. The plug-in connector according to claim 6, characterized in that the arm attachment (31) extends transversely to the locking arm on which it is arranged.

8. A plug-in connector for connection to a firing element receptacle, having a plug adapter, first locking arms and a plug body, the plug body having a cable-receiving groove, a connecting cable which is connected to contacts and having a housing cover, which rests on the upper side of the plug body, and where the plug body and the cover are provided with openings shaped in such a way that they receive secondary locking arms therein, said secondary locking arms in the state in which they are inserted into the plug body lie between the plug adapter and the first locking arms, in order to fix the first locking arms in this vertical position, characterized in that at least one of the secondary locking arms is provided with an arm attachment, which is shaped in such a way that it removes a jumpering clip from at least one contact pin in the firing element receptacle.

9. The plug-in connector according to claim 8, characterized in that the arm attachment extends transversely to the secondary locking arm on which it is arranged.

10. The plug-in connector according to claim 9, characterized in that the cable receiving groove has teeth to hold the cable and in that fastening of the housing cover on the upper side of the plug body takes place by means of lateral and rear fastening lugs, which extend downwards from the cover, the rear fastening lugs being clipped into by detents, which are arranged on U-shaped flexible legs, which in turn are arranged in the vicinity of the cable-receiving groove on the plug body.

11. The plug-in connector according to claim 10, characterized in that the U- shaped flexible legs are arranged with the bent part upwards and have a first straight leg, the free end of which is connected to the plug body at its bottom, having a curved region which extends to the upper side of the plug body and a second straight leg, at the free end of which the detent is arranged.

12. The plug-in connector according to claim 11, characterized in that the underside of the cover has U-shaped profiles, which are shaped to complement the second straight leg and at least part of the curved part of the U-shaped flexible leg, so that these profiles receive the flexible legs and the rear fastening lugs of the cover represent part of these profiles.

* * * * *